United States Patent [19]

Murray

[11] 4,347,778

[45] Sep. 7, 1982

[54] REVERSIBLE FLUID UNIT

[76] Inventor: Jerome L. Murray, 652 First Ave., New York, N.Y. 10016

[21] Appl. No.: 67,224

[22] Filed: Aug. 17, 1979

[51] Int. Cl.[3] ..... F01L 33/02; F01B 1/06; F04B 1/04

[52] U.S. Cl. ..... 91/180; 91/491; 91/503; 417/269; 417/475

[58] Field of Search ..... 91/6.5, 180, 491, 503; 417/474–477, 269

[56] References Cited

U.S. PATENT DOCUMENTS

| | | | |
|---|---|---|---|
| 727,772 | 5/1903 | Fenton | 91/6.5 |
| 2,052,472 | 8/1936 | Hyman | 91/180 |
| 2,392,279 | 1/1946 | Woods | 91/180 |
| 3,019,772 | 2/1962 | Humphrey | 91/180 |
| 3,280,703 | 10/1966 | Humphrey | 91/180 |

FOREIGN PATENT DOCUMENTS

| | | | |
|---|---|---|---|
| 1453668 | 6/1969 | Fed. Rep. of Germany | 417/475 |
| 2634065 | 2/1978 | Fed. Rep. of Germany | 91/6.5 |
| 2279956 | 2/1976 | France | 417/474 |

*Primary Examiner*—William L. Freeh

*Attorney, Agent, or Firm*—Curtis, Morris & Safford

[57] ABSTRACT

A reversible fluid unit which may be used as a motor, pump, brake or clutch. The unit has a plurality of sequentially inflatable diaphragms, to impart a rotative force to a plurality of roller members. When used as a motor, brake or clutch, air under pressure is sequentially fed to the plurality of diaphragms which inflate against roller members connected to a driven output shaft. As the diaphragms inflate, the roller members are contacted by the inflated diaphragms to impart or brake rotary motion thereto. When used as a pump, the rollers are rotated to pump air out through the diaphragm members.

15 Claims, 16 Drawing Figures

10
12
14
16
18
20
22
24
26
3
32
36
38
44
52
54
56
57
58
60
62
64
66
70
72
74
76
78
80
84
86
88
90
92
96
98
100
106
144
146

REVERSIBLE FLUID UNIT

The present invention relates to pneumatic devices and, more particularly, to such devices which can be used as a motor, brake, pump or clutch.

Prior to the present invention, reversible fluid units which may function as either a pump or motor have been proposed which use fluid conducting flexible tubes which, in motor applications, are inflated to drive a roller and, in pump applications, are compressed to pump a fluid. Typically, the tubes are disposed in an arc of about 180° and, in such prior art constructions, the inlet of each tube is supplied with a fluid and is then subjected to a progressive squeezing action by the rotating rollers. While these prior art reversible fluid devices are suited for numerous applications, they often cannot be operated for extended time periods since the service life of the tube is greatly diminished by the constant flexing action imposed by the orbiting rollers. Also, there is a tendency for the tube to creep during operation which stretches and strains the tubing detracting from its durability. All of this adds to maintenance burden and costs and limits the use of such units to environments readily accessible for maintenance. In addition, such prior art pneumatic devices used as motors do not provide a uniform torque output over a range of varying output speeds as speed control is typically accomplished by changing the air pressure input.

It is, therefore, an object of the present invention to provide a new and improved reversible fluid device which can function as a motor, pump, brake or clutch and which overcomes many of the drawbacks of prior art devices of this type.

It is a still further object of the present invention to provide a reversible fluid device which can function as a motor, pump, brake or clutch which is of simple but durable construction.

It is yet another object of the present invention to provide a reversible fluid device which when functioning as a fluid driven motor provides a high uniform torque output at varying speeds.

In a preferred embodiment of the present invention a plurality of sequentially inflatable diaphragms or bladders act on a plurality of roller members secured to an output shaft of the device. As each bladder inflates sequentially it acts upon and drives one of the roller members to impart rotary motion thereto. A precisely controlled metering valve is provided to meter and sequentially feed fluid under pressure to each diaphragm in sequence to insure smooth and continuous output.

Other objects and advantages of the present invention will be more readily apparent from the following detailed description and drawings in which.

Figures 1, 2:
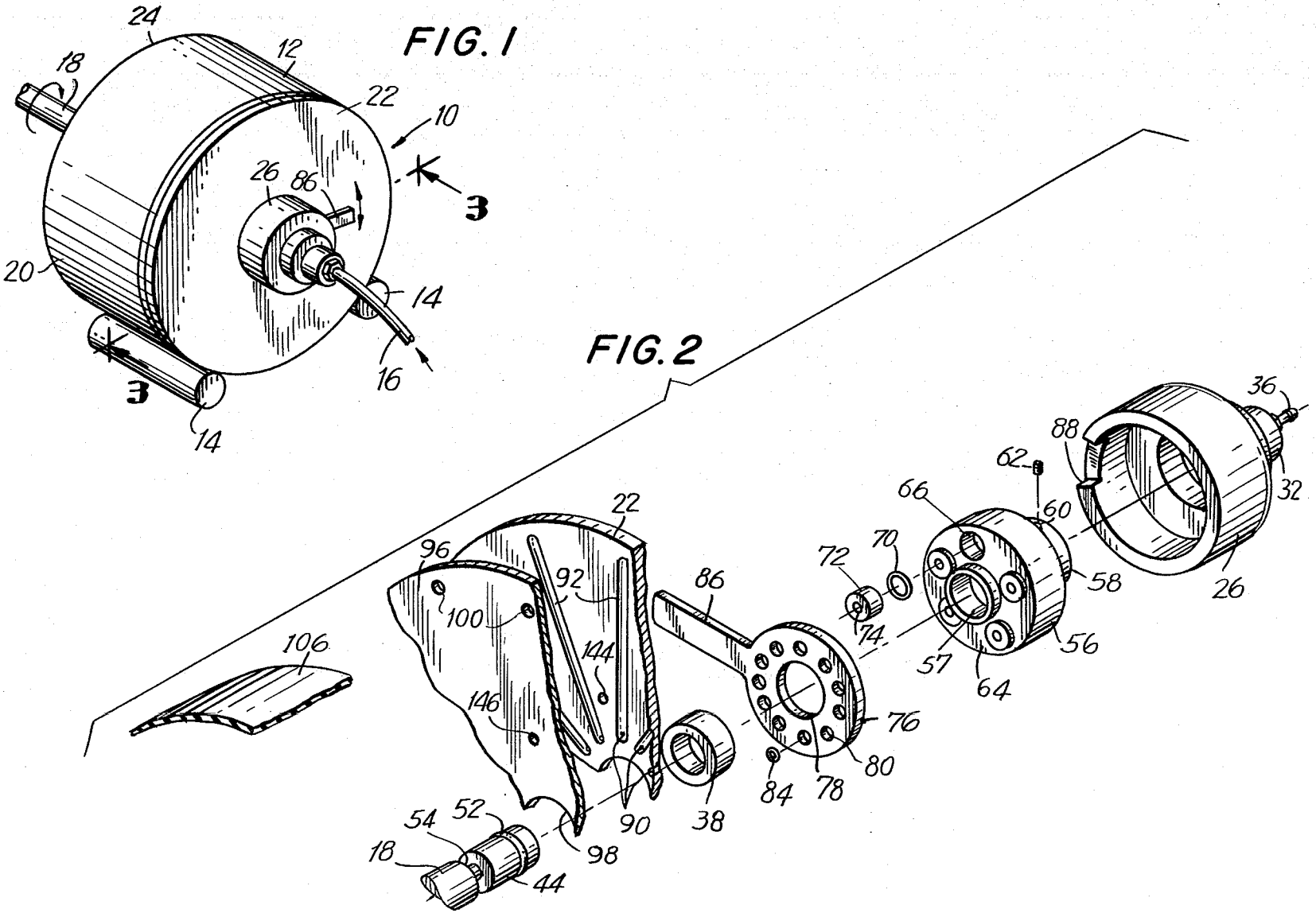
FIG. 1 is an overall perspective view of the reversible fluid device of the present invention.
FIG. 2 is an exploded perspective view of significant details of the present invention.

With reference to the drawing, and particularly FIGS. 1 to 4, the reversible fluid device 10 of the present invention includes a cylindrical housing 12 mounted on suitable support members 14 and includes a fluid intake line 16 through which, when the device is used as a motor, a suitable fluid such as air under pressure is introduced. An output shaft 18 is also provided which, when the device is used as a motor, is rotated by the interaction of the diaphragms and rollers within housing 12 as will be explained more fully hereinbelow. The housing 12 includes a cylindrical shell 20 and circular end plates 22 and 24 at each open end of the cylindrical shell 20 suitably affixed in any convenient manner.

Figure 3:
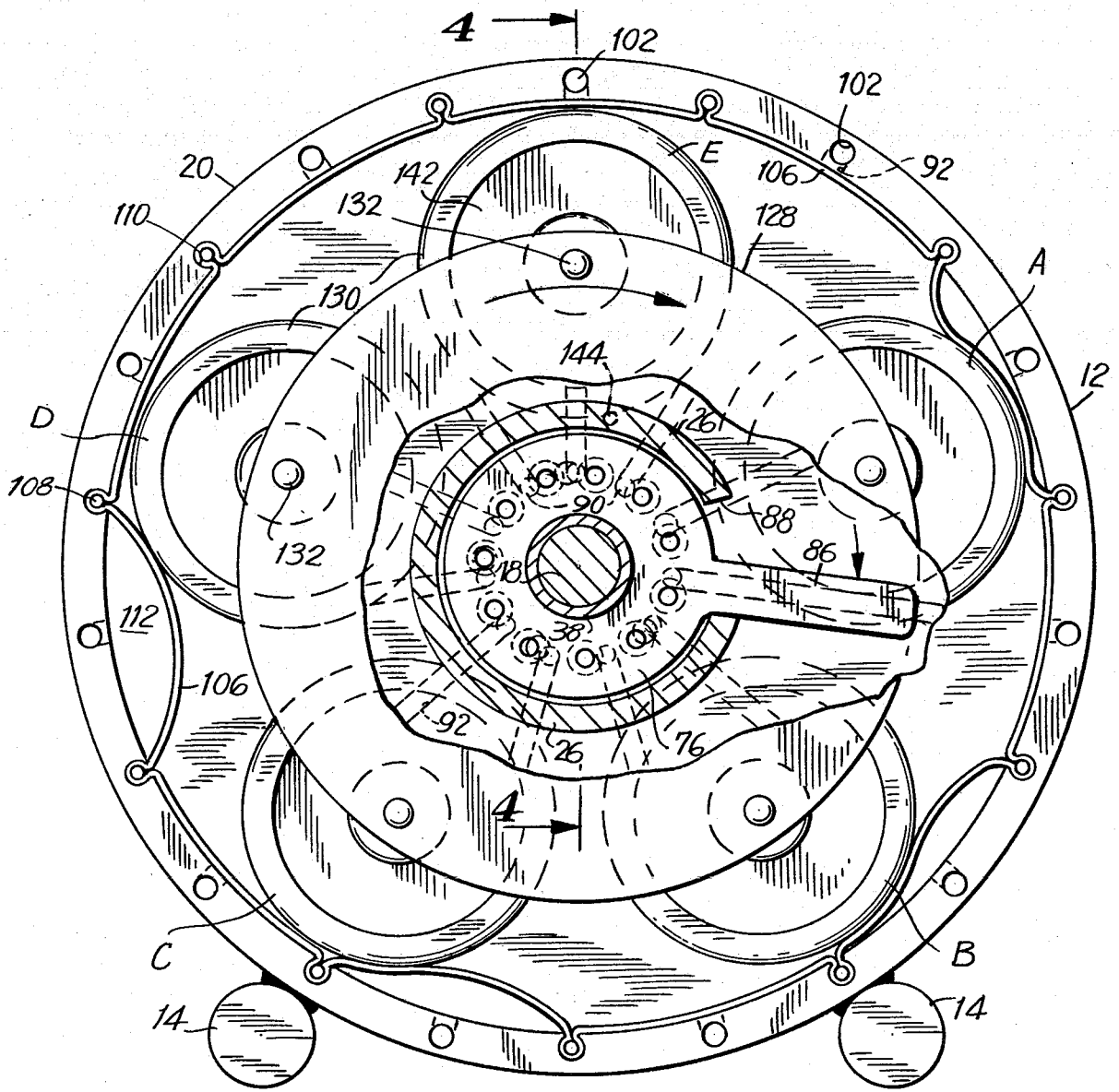
FIG. 3 is an elevational view, partly in section, showing one embodiment of the present invention.

Mounted to end plate 22 is a housing assembly 26 which secures air line 16 and within which is mounted an air distribution assembly. As best seen in FIGS. 2 and 3, housing 26 includes a first cylindrical portion 28, a second cylindrical portion 30 having an outer diameter less than the outer diameter of cylindrical portion 28, and a third cylindrical portion 32 having an outer diameter less than the outer diameter of portion 30. Cylindrical portion 32 of housing 26 includes a threaded bore 34 therethrough within which is threaded an air nozzle connection member 36 on which the air hose 16 is suitably affixed.

Figure 4:
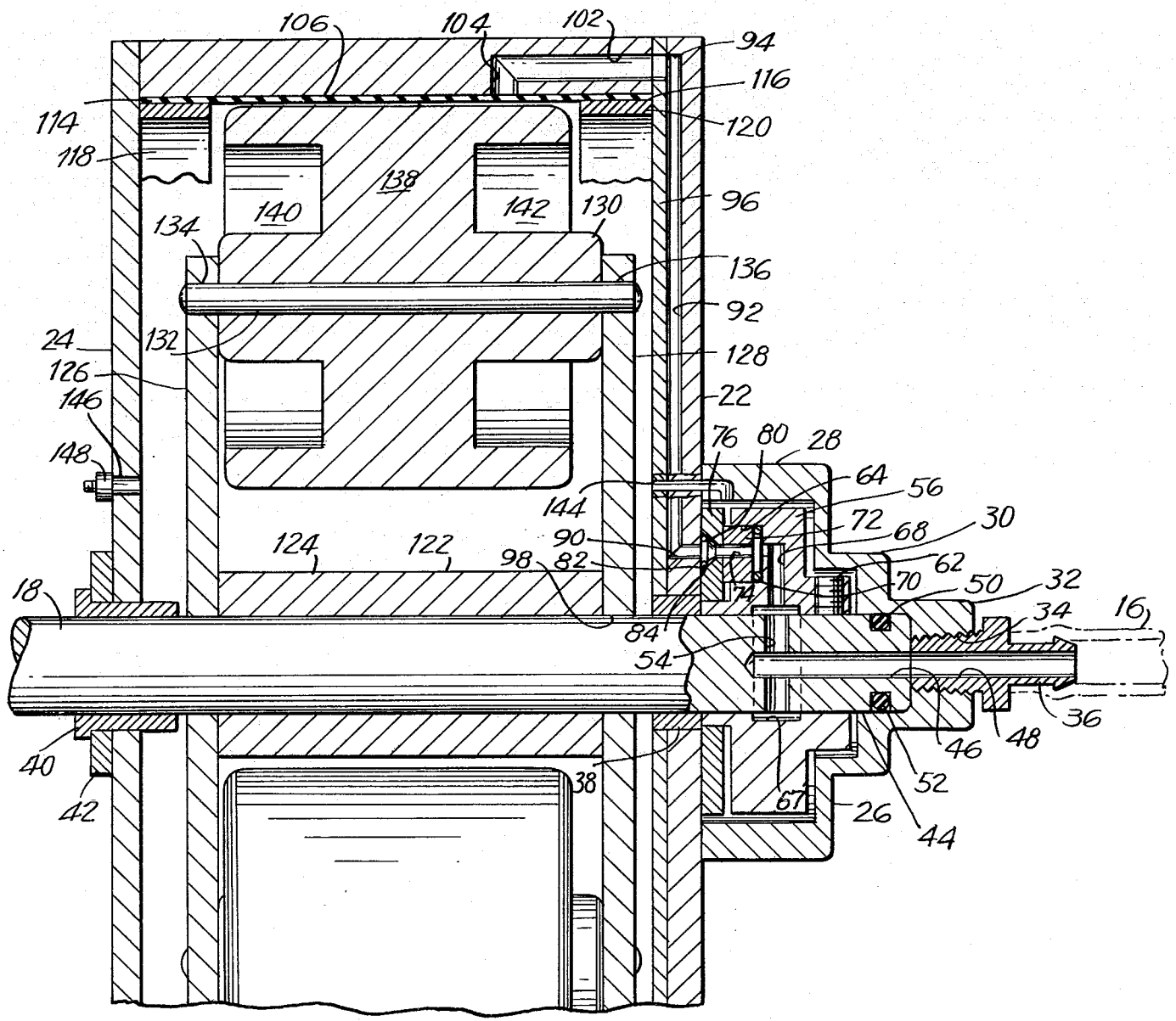
FIG. 4 is a sectional view taken along line 4—4 of FIG. 3.

As best seen in FIG. 4, output shaft 18 is journaled within end plates 22 and 24, respectively, and is supported for free rotation therein by bearings 38 and 40, respectively. An end cap 42 is also provided about bearing 40 on end plate 24. Shaft 18 includes an end 44 which extends into housing 26 and is provided with an air access bore 46 communicating with an air passage 48 in nozzle connection member 36. End 44 of shaft 18 also includes a channel 50 therein within which is fixed an O-ring 52 to prevent air flow around the end 44 of shaft 18. In addition, end 44 of shaft 18 includes a lateral through bore 54 communicating with air access bore 46 so that air under pressure flowing from air hose 16 through nozzle connection member 36 is introduced to the interior of housing 26.

An air distribution housing 56 is disposed about end 44 of shaft 18 within housing 26. Housing 56 includes an axial bore 57 to receive shaft 18 and a shoulder portion 58 having a threaded through bore 60 therein to receive a threaded set screw 62 to secure distributor housing 56 to end 44 of shaft 18. Thus, the air distribution housing 56 is fixed to shaft 18 and rotates with shaft 18.

Air distribution housing 56 includes an end face 64 having a plurality of counter bores 66 at circumferentially spaced locations thereon which extend partway through the housing 56. Housing 56 also includes an air access channel 67 machined into the inner cylindrical surface of housing 56 adjacent axial bore 57 and a plurality of radiating air access ports 68 radiating outwardly from the air access channel 67 to communicate with each counter bore 66. Thus, an air communication passage is formed through shaft end 44 and to each counter bore 66. Disposed within each counter bore 66 is an O-ring 70 and a nylon washer 72 to seal the air access passage and limit air flow only through the access hole 74 in washer 72.

A control plate 76 is provided within housing 26 adjacent air distribution housing 56. Control plate 76 is a circular plate member having an axial through bore 78 to accommodate end 44 of shaft 18 and a plurality of circumferentially spaced air access ports 80 spaced radially outwardly from shaft through bore 78. The air access ports 80 are countersunk, as at 82, to receive an O-ring to effectively seal the air passage. Air access ports 80 are spaced radially outwardly from the axial center of plate 76 so as to be registrable with the air access holes 74 positioned in air distribution housing 56. Plate 76 also includes an extending handle member 86 which extends outside of housing 26 through a handle access slot 88. Handle 86 is thus accessible from exterior to housing 26 to control the alignment of air access ports 80 in plate 76 with respect to the air access holes 74 within counter bores 66 in distribution housing 56, as will be explained more fully hereinbelow.

As best seen in FIGS. 2–4, a plurality of circumferentially spaced air access ports 90 are provided in end plate 22 radially spaced from the central axis of plate 22 so as to be registrable with the air passage defined by air access ports 80 in control plate 76. The inner face of end plate 22 is provided with a plurality of radiating radially directed channels or grooves 92 extending from each axis port 90 outwardly to a point 94 adjacent the periphery of end plate 22. A backup plate 96 is provided within housing 12 adjacent to end plate 22. Backup plate 96 includes an axially disposed through bore 98 to accommodate shaft 18 and a plurality of circumferentially spaced air access ports 100 adjacent the peripheral extent of backup plate 96 and spaced to register with the termination 94 of grooves 92. Housing shell 20 includes a plurality of axially directed air access bores 102 terminating in a radially directed air access port 104 to provide an air passage to the interior of housing 12. The access bores 102 are circumferentially spaced and located to be in register with the access ports 100 in backup plate 96. Backup plate 96 is disposed in close fitting relationship to end plate 22 and, thus, with end plate 22 defines an air access passage from air distribution housing 56 to the interior of housing 12.

A flexible diaphragm 106 formed as a cylindrical segment of any suitable flexible rubber or rubber-like material is mounted on the inner surface of cylindrical shell 20. As shown in FIG. 3, diaphragm 106 is retained in position by cylindrical rods 108 disposed within circumferentially spaced key hole slots 110 in housing 20 such that adjacent pairs of rod retainers 108 and key hole slots 110 fix diaphragm 106 to the housing. The opposed lateral edges 114 and 116, respectively, of the diaphragm 106 are sealed within housing 12 by sealing rings 118 and 120, respectively and thus define a plurality of circumferentially spaced diaphragm chambers 112. Thus, each diaphragm chamber 112 is a sealed inflatable chamber. Diaphragm 106 is positioned so that each separately inflatable chamber 112 is fed and separately inflatable by one of the air access ports 104.

A hub assembly 122 is fixed to shaft 18 within housing 12 and includes a central bearing segment 124 secured to shaft 18 in any conventional manner and circular end plates 126 and 128, respectively, secured to central bearing segment 124. A plurality of roller members 130 are rotatably secured to end plates 126 and 128 at circumferentially spaced locations thereabout on a shaft 132 journaled at each end 134, 136 in end plates 126 and 128, respectively. Each roller assembly 130 includes a tire segment 138, preferably of a material such as nylon, and supporting end caps 140, 142, respectively.

In operation when the reversible device 10 of the present invention is used as a motor, air under pressure is fed through line 16 into housing 26, through distributor 56 and through the communicating air passages sequentially to inflate the individual diaphragm chambers 112. In the embodiment illustrated in FIGS. 2–4, five roller assemblies 130 are provided along with 11 separately inflatable diaphragm chambers 112. Other arrangements can be utilized, for example, four rollers with nine diaphragm chambers as well. The essential feature in any geometric arrangement is to insure that the diaphragm chambers are inflated sequentially when a roller element is positioned just past the mid-point of the diaphragm chamber. An effective geometric arrangement is to provide twice the number of rollers plus one diaphragm. In this manner, the inflation of the diaphragm chamber acts on the roller element to impart relative rotation to it, and consequently to the hub assembly secured to the output shaft 18. In essence, the roller element 130 rolls down the infated diaphragm chamber 112.

In a first position illustrated in FIG. 3, the control lever 86 is moved to the downward position, as viewed in FIG. 3, to align the air access ports 80 in control plate 76 with the air access ports 90 in end plate 22. With the embodiment shown in FIGS. 3 and 4, having five roller members, it is seen that the distribution housing 56 is also provided with five air access ports which sequentially register with the air access ports 80 in control plates 76 as shaft 18 is rotated since the air distribution housing 56 is fixed to shaft 18. Thus, as each air access hole 74 in housing 56 rotates to register with an air access port 80 in control plate 76, a pulse of air under pressure is fed to the corresponding diaphragm chamber 112. The distribution of air is sequenced in such a manner so that an individual chamber 112 is inflated just after a roller member 130 passes the mid-point of the chamber. As seen in FIG. 3, the roller 130 designated as A has just passed the mid-point of the diaphragm housing and that diaphragm housing 112 is beginning to inflate to impart clockwise rotation to the shaft and hub assembly. The roller designated as B is shown as being more advanced with respect to its adjacent diaphragm housing and the rollers designated as C and D are shown in slightly more advanced position with respect to the corresponding diaphragm housing. The roller designated as E is just coming to the mid-point of its adjacent diaphragm housing and the air access bore for that diaphragm housing is just coming into register with a supply of air to begin its inflation process.

Figure 5:
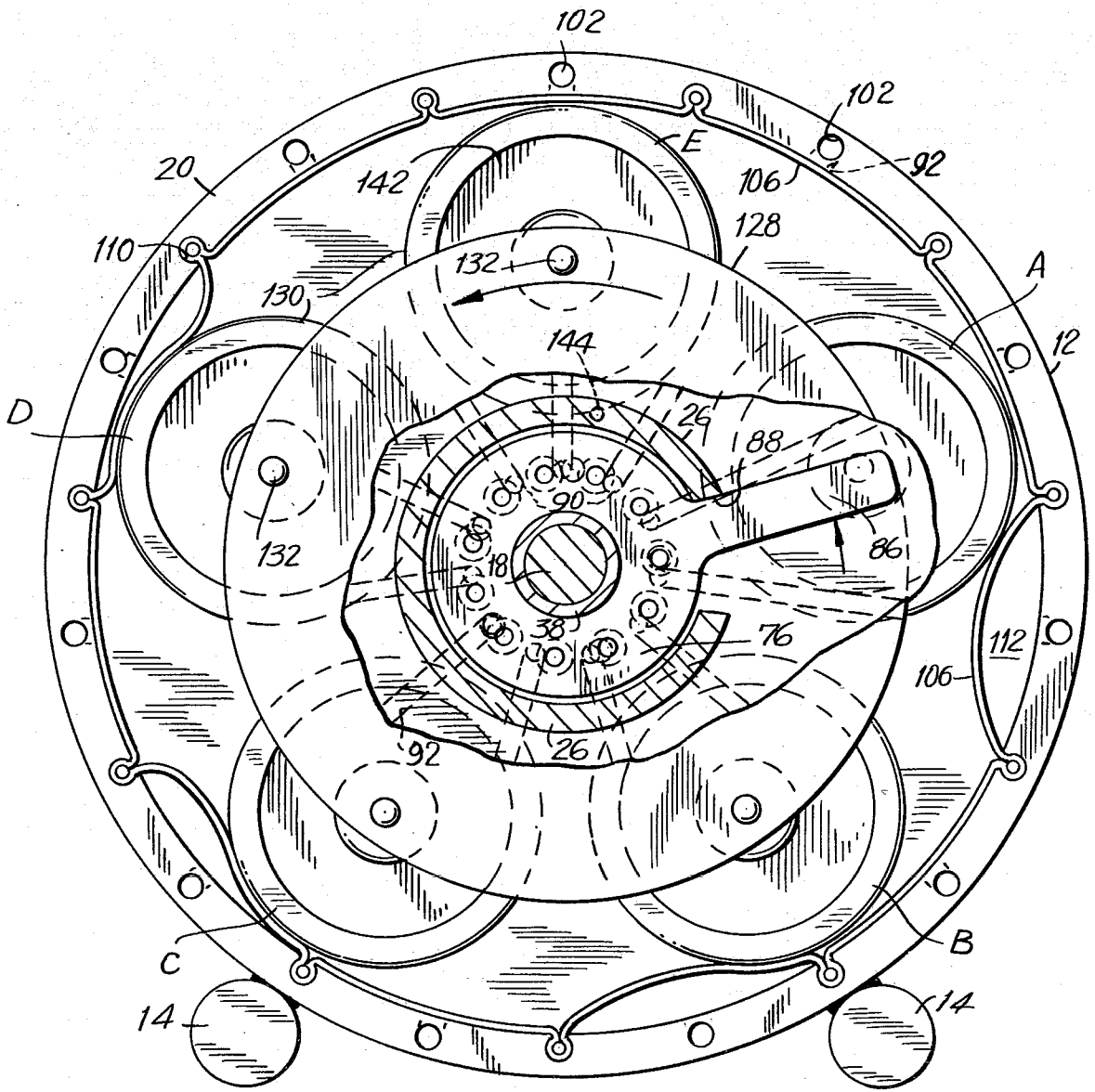
FIG. 5 is a view similar to FIG. 3 showing the invention in a reverse mode of operation.

Since the direction of rotation of the rollers and shaft 18 is dependent upon the position of the rollers with respect to the diaphragm housing when the diaphragm housing is inflated, the direction of rotation can be reversed by changing the sequence with which the diaphragm housings are inflated. Thus, by changing the position of the control plate 76 with respect to the air access ports 90 in end plate 22, the sequence of diaphragm inflation can be altered to impart a counterclockwise rotation to the rollers as shown in FIG. 5. Accordingly, by moving the control handle 86 upwardly, as viewed in FIG. 5, the registry of air access ports 80 with the air access ports 90 in end plate 22 is moved one position in the counterclockwise direction so that the rollers 130 in registry with a diaphragm which is inflated is positioned in the counterclockwise direction of the mid-point of the inflated diaphragm. Thus, as the diaphragm inflates, a counterclockwise rotation is imparted to the rollers and the output shaft 18.

The position of control plate 76 may also be used to fine-tune the output of shaft 18 and also to place the motor in a neutral mode of operation. By moving control pate 76 to a neutral position, approximately midway between the positions shown in FIGS. 3 and 5, the air access ports 80 are aligned midway between air access bores 90 in end plate 22 so that no air is fed into housing 12. With no air entering the diaphragm chambers, diaphragm 106 is not inflated and no rotation is imparted to the output shaft 18.

Each diaphragm housing 112 is inflated by a pulse of air as the air access ports 66 from the air distribution housing rotate into register with the air access ports 90. Thus, as soon as the pulse of air is removed, each inflated diaphragm housing is deflated to return to its flattened position along the interior of housing 20. The deflation is assisted by an oncoming roller element bearing against the first half of a diaphragm membrane and in addition is assisted in its movement to its deflated position by a differential pressure maintained within housing 12.

That pressure is supplied through an air access port 144 formed through backup plate 96 and end plate 22 and extending into housing 26 where the return air coming from the deflated diaphragm housings 112 is led into the interior of housing 12. An air exhaust port 146 is provided within end plate 24 and a screw-type metering valve 148 is provided on the exterior of end plate 24 to control the air flow out of housing 12 through exhaust port 146. By controlling the flow of air exhausting from the housing 12, a slight differential pressure can be maintained within the housing to assist in the deflation of the diaphragm housing. In addition, precise control of the flow of air out of metering valve 148 provides a speed control for the rotation speed of shaft 18.

Thus, the present invention provides a means of controlling the output speed in an air motor device without affecting the torque output of the device. Prior art air motors control the output speed by changing the input pressure of the air which also results in a change in the torque output. The present invention provides an air motor which allows the adjustment in output speed without diminishing torque output. It also provides the significant advantage that a uniform source of air under pressure can be used without requiring extraneous valving devices at the air input to the device.

Figure 6:
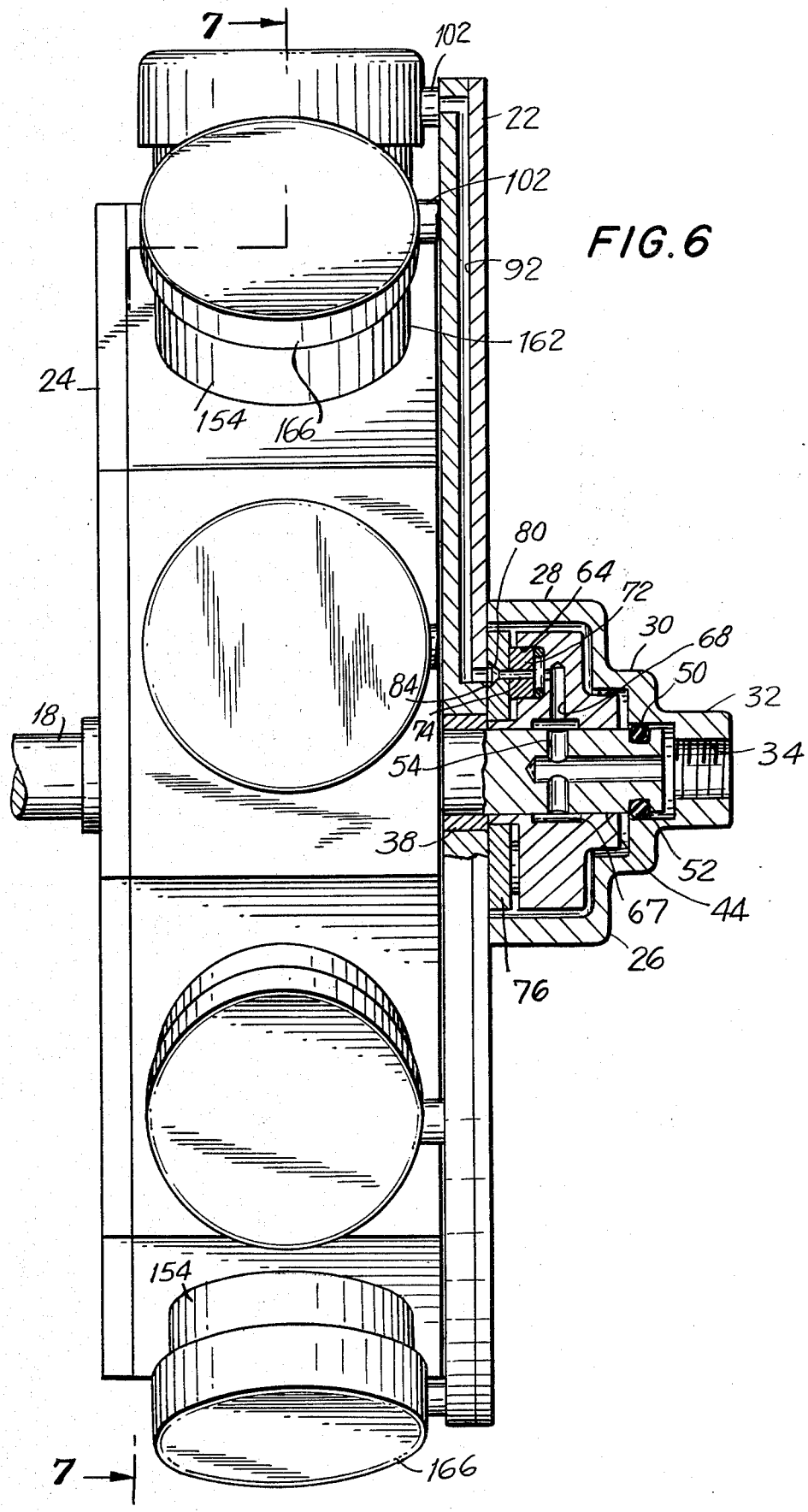
FIG. 6 is a side elevational view showing an alternate embodiment of the present invention.
Figure 7:
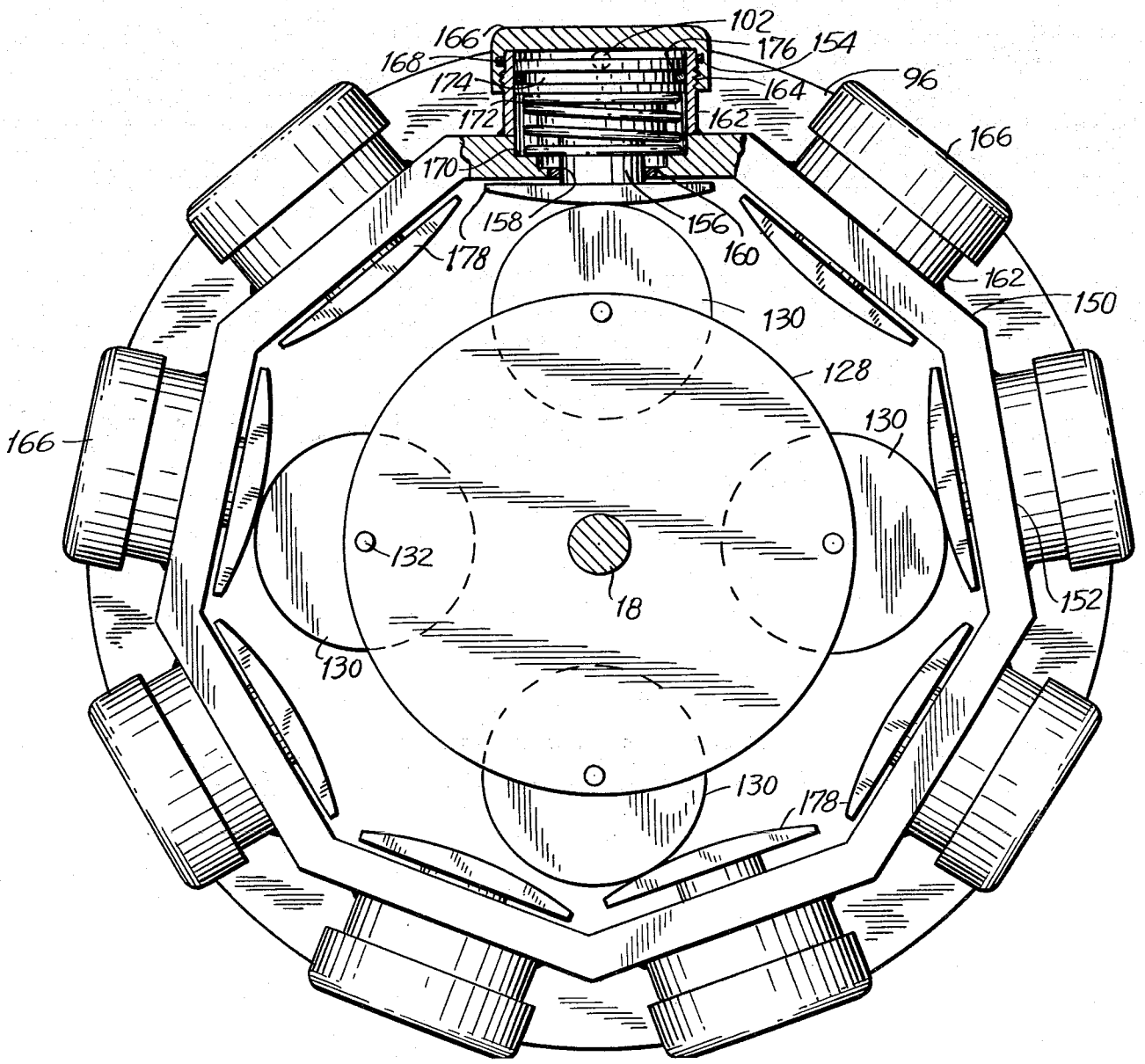
FIG. 7 is a front elevational view of the embodiment of FIG. 6.

Reference is now made to FIGS. 6 and 7 for an alternate embodiment of the reversible fluid device of the present invention. In FIGS. 6 and 7, like numerals are used to designate elements which are the same as elements in the embodiments of the invention illustrated in FIGS. 3–5. In this embodiment of the invention, housing shell 150 is a polyhedron in cross section, for example a nonagon as illustrated in FIG. 7. Each side 152 of the housing shell 150 has mounted thereon a spring actuated diaphragm assembly 154 which functions as the diaphragm 106 in the embodiment of FIGS. 3–5 to propel the rollers 130 and shaft 18 in the same manner.

Each diaphragm assembly 154 includes a piston member 156 disposed for reciprocal movement within a through bore 158 in one of the sides 152 of the housing shell. A suitable seal 160 is also provided to preclude leakage of air from within the diaphragm assembly 154. The piston 156 is disposed within a cylindrical housing 162 fixed to the exterior of the housing shell 150. Housing 162 is threaded near its upper end as at 164 to threadably engage an end cap 166 which is also provided with a seal 168 to preclude air leakage. Within housing 162 the exterior of housing shell 150 is undercut to form a shoulder 170 which forms a bearing seat for a compression spring 172. The upper end of piston 156 includes a flanged portion 174 provided with a sealing member 176 against which spring member 172 bears. Thus, the piston 156 is urged to remain in a retracted position by the spring 172. Air inlet port 102 is located above piston 156 and, when air under pressure is introduced into housing 162, the pressurized air within the chamber urges the piston 156 to extend into the interior of the housing shell 150. Affixed to the lower end of piston 156 and disposed within the interior of the housing shell 150 is a roller contacting pad 178 which, as piston 156 is urged to move radially inwardly, contacts the roller to impart rotatable motion thereto in the same manner as the diaphragm chamber 112 imparts rotation in the embodiment of FIGS. 3–5. As in the embodiment of FIGS. 3–5, the pulsing air introduced into the diaphragm housing assembly 154 is sequenced to pulse just after a roller assembly 130 has past the mid-point of the roller contacting pad 178.

Each of the embodiments of FIGS. 3–5 and FIGS. 6 and 7 can also be operated as a pneumatic pump. In such a use, shaft 18 would be rotated by an external power source and the rollers would act on inflated bladders, in the embodiments of FIGS. 3–5, to deflate the bladders thereby forcing air out through the access ports through the distributor housing 56 and into the hose 16. For the embodiment of FIGS. 6 and 7, a slight modification is necessary in placing the compression spring between the end cap 166 and the top of the piston flange 174 so that the normal position for the piston would be its radially inward extended mode. Thus, as the rollers rotate under the force of the rotating shaft 18, the pistons would be compressed by the rotating rollers to pump air out of the device.

Figure 9:
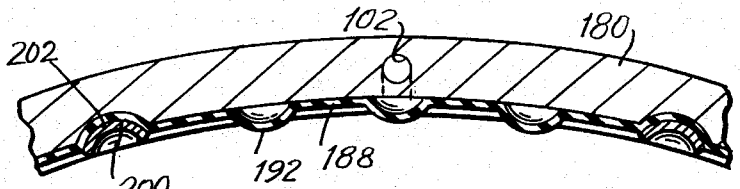
FIG. 9 is a sectional view taken along line 9—9 of FIG. 8.
Figure 8:
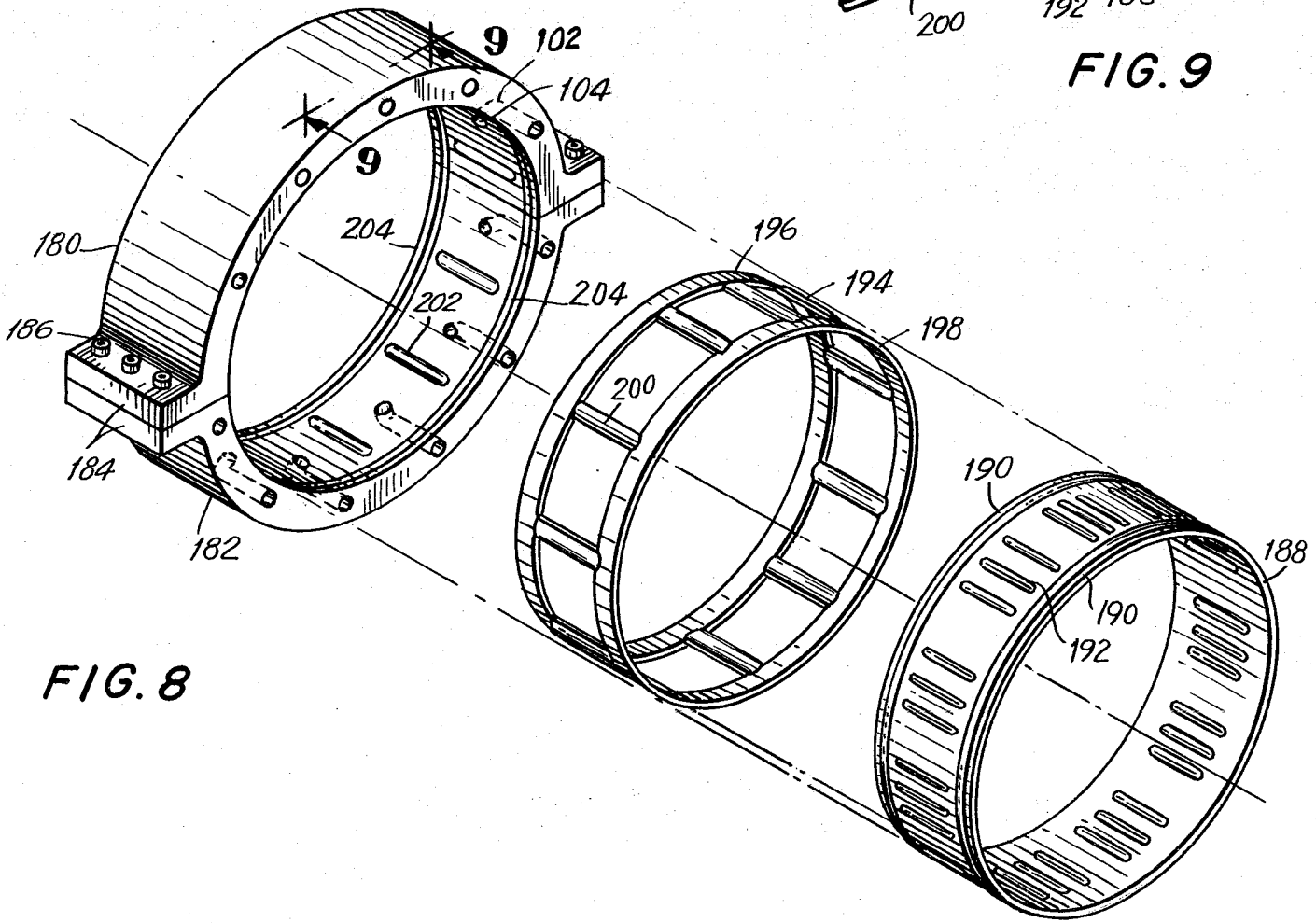
FIG. 8 is an exploded perspective view of a detail of an alternate embodiment of the housing of the present invention.

Reference is now made to FIGS. 8 and 9, where an alternate embodiment for the positioning of the diaphragm is shown. In this embodiment, the shell of the housing comprises half sections 180 and 182, respectively, each having flanged extensions 184 suitably secured together by bolts 186. The flexible diaphragm 188 is a cylindrical segment of flexible rubber or rubber-like material formed with a molded beaded seal 190 at each lateral edge. In addition, the diaphragm is provided with molded protrusions 192 which extend longitudinally and are spaced inwardly from the lateral edges at circumferentially spaced intervals in the diaphragm between the molded beaded edges. The series of molded protrusions 192 are spaced to coincide with the portion of the diaphragm which inflates to act against the rollers. A retaining cage assembly 194 is provided which includes a pair of cylindrical segments 196, 198 interconnected by a plurality of circumferentially spaced arcuate connecting struts 200. The inner face of housings 180 and 182 are provided with complimentary receiving channels 202 for the struts 200 and mating circumferential channels 204 to receive the molded beaded edge of the diaphragm 188. The diaphragm 188 is inserted within the housing halves 180, 182 with the series of protrustions 192 centered about each air access port 104 and the retaining cage 194 is inserted to firmly secure the diaphragm within the shell housing as best seen in FIG. 9.

Figure 11:
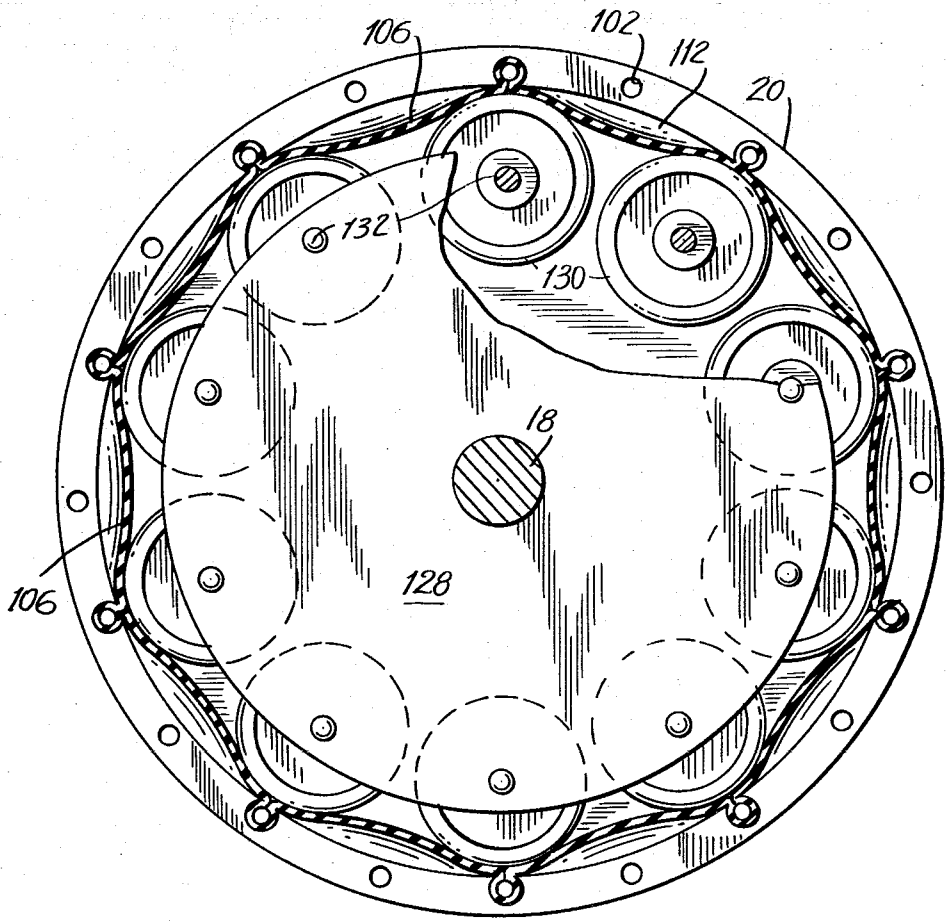
FIG. 11 is a sectional view taken along line 11—11 of FIG. 10.
Figure 10:
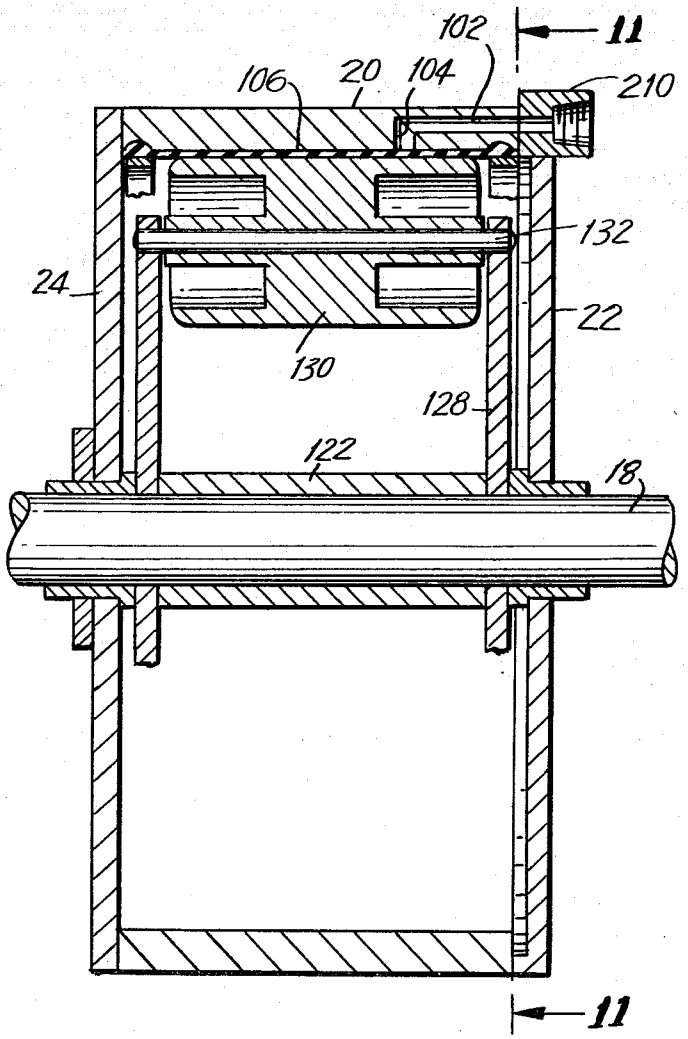
FIG. 10 is a side sectional view showing an alternate embodiment of the present invention.

Reference is now made to FIGS. 10–13 which show an alternate embodiment of the reversible fluid device of the present invention which is used as a brake. In this embodiment of the invention, the diaphragm chambers are inflated to stop the rotation of a driven shaft member and, accordingly, when used as a brake, the device of the present invention is interposed between a driving source, such as a motor, and a driven member such as a tool. As in the description of the prior embodiment, like reference numerals in FIGS. 10 and 11 are used to describe elements which are of the same or similar construction as the elements described in the embodiment of FIGS. 3–5.

Thus, it is seen that the housing 20 is provided having end plates 22 and 24 with a driven shaft 18 therethrough on which is fixed the hub assembly 122 carrying the plurality of circumferentially spaced roller members 130. The diaphragm 106 is secured along the inner face of housing 120 to define a separate diaphragm chamber 112 for each of a plurality of circumferentially spaced air access ports 104 communicating with air access bore 102. In the embodiment of the invention used as a brake, air under pressure is not supplied through radiating channels in end plate 22 but is supplied individually to each air access bore 102 through a separate air connection port 210 which may receive a separate air line from a source of air under pressure or from a suitable manifold arrangement receiving air from a single source of air under pressure.

In the brake embodiment of the present invention, the same number of rollers and diaphragms are used as the inflation of the diaphragm chambers is designed to impede the rotation of the roller members to stop or brake the rotation of the shaft 18 keyed to the roller carrying assembly. Thus, air under pressure is pulsed and maintained to the brake embodiment of the present invention only when it is desired to stop the rotation of the shaft 18. Thus, as viewed in FIG. 11, when each of the separate diaphragm chambers 112 inflates, because of the geometry of the arrangement, the inflation of chambers 112 creates an impediment to the rotation of the roller members 130 within the housing to effectively stop the rotation of the rollers and, hence, stop the rotation of driven shaft 18. As soon as air under pressure is removed, the rotative force on shaft 18, which is now not impeded by the inflated diaphragm chambers, resumes rotation of the roller members to exhaust the air tending to inflate the diaphragm chambers so that the diaphragm 106 is again maintained in a flattened position against the interior surface of housing 20.

Figure 13:
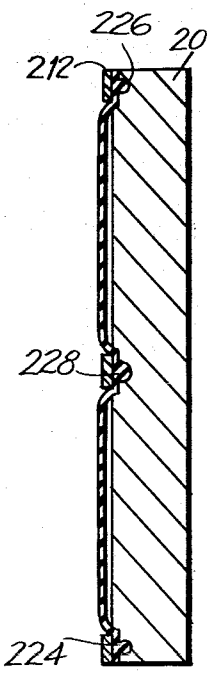
FIG. 13 is a sectional view taken along line 13—13 of FIG. 12.
Figure 12:
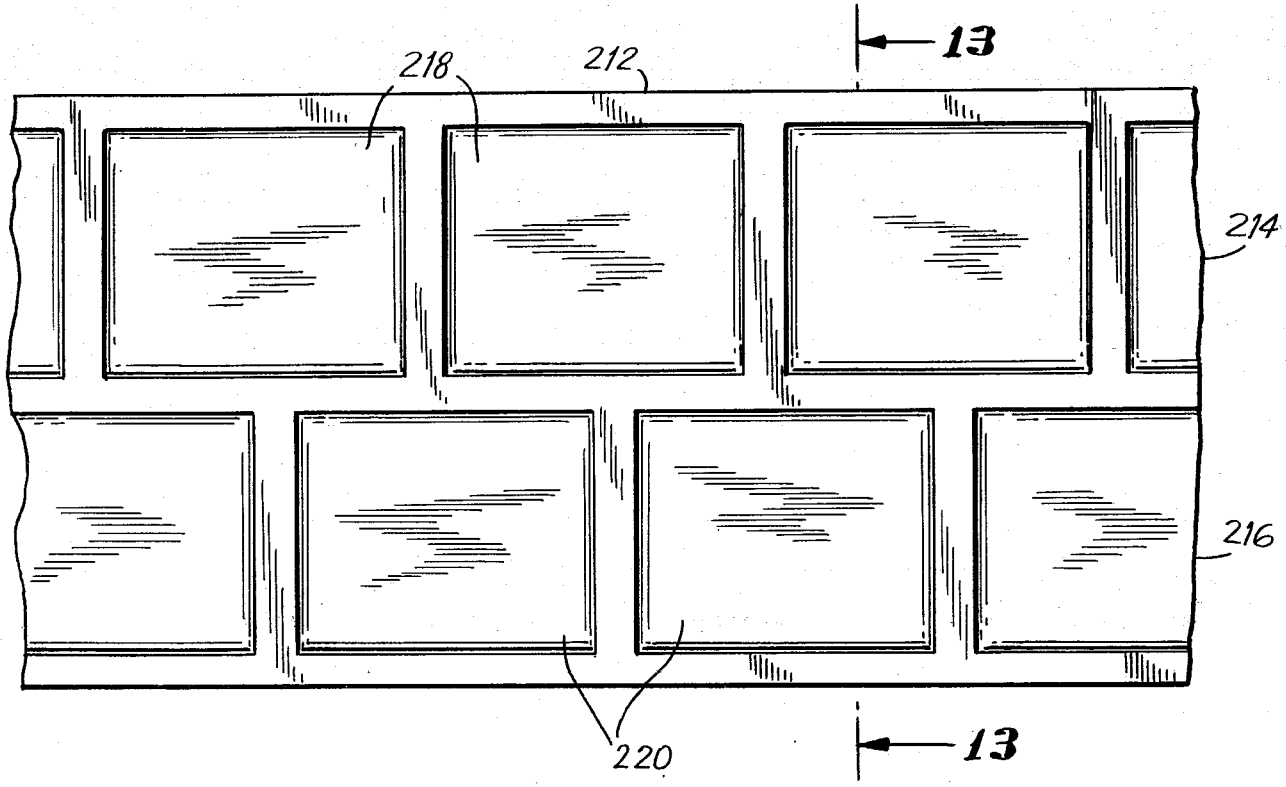
FIG. 12 is an illustration of a detail of an alternate embodiment of the embodiment shown in FIG. 11.

Reference is now made to FIGS. 12 and 13 which show an alternate embodiment for a diaphragm assembly which may be utilized in the brake embodiment of the present invention illustrated in FIGS. 10 and 11. In this embodiment, diaphragm 212 is provided with two separate inflatable bands 214 and 216, respectively, of separately inflatable diaphragm chambers 218 and 220, respectively. As shown, diaphragm 212 is secured at each lateral edge 224, 226 as well as secured along its mid-portion 228 to the housing 20. Each separate inflatable chamber 218 and 220, which are disposed in alternating parallel alignment, are each simultaneously and separately inflatable upon the introduction of air under pressure to the air access port in housing 20. Thus, the diaphragm member 212 of this embodiment provides a greater number of inflatable diaphragm chambers alternately disposed to provide a greater braking and restraining force on the continued rotation of roller members 130.

Figure 14:
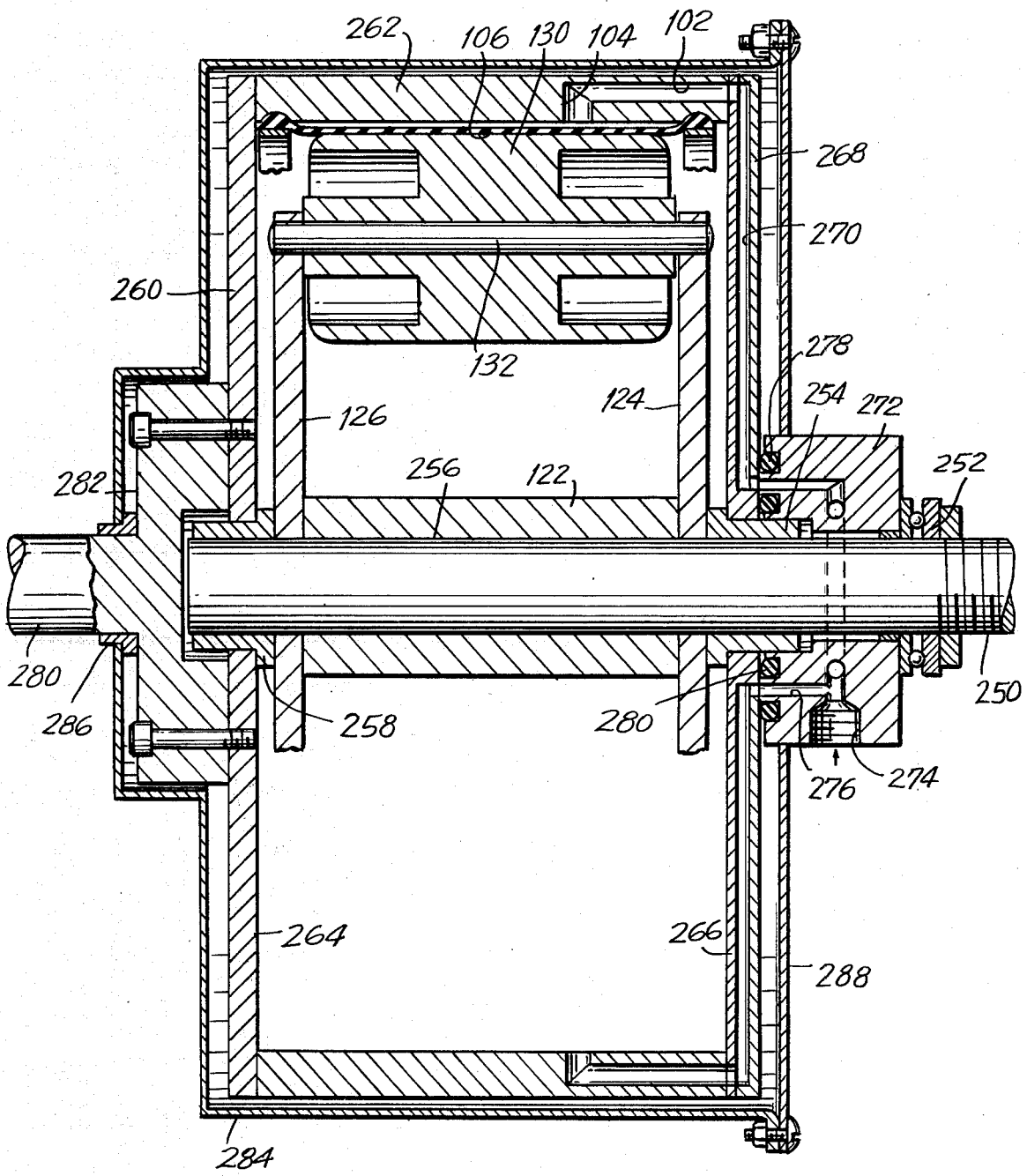
FIG. 14 is a sectional view of still another embodiment of the present invention.

Reference is now made to FIG. 14 which shows still another embodiment where the invention is used as a clutch interposed between a driven input shaft and an output shaft. In this embodiment, the arrangement of rollers and diaphragms is similar to the arrangement of the brake embodiment of the invention so that in the brake mode with all diaphragms inflated, the input shaft is keyed to the output shaft by the interlock between the rollers and the separately inflatable diaphragms. With the diaphragms in the deflated condition, the driven shaft free wheels with respect to the output shaft and no power is transmitted from the input driven shaft to the output shaft.

Thus, as shown in FIG. 14, a driven input shaft 250 is shown supported and journaled in bearing assemblies 252 and 254 and has its end 256 keyed to a hub assembly 122 carrying a plurality of circumferentially spaced roller members 130. The free end of driven shaft 250 is also journaled within a bearing 258 about which is also journaled, for free rotation relative to shaft 250, a housing assembly 260. Housing assembly 260 includes a cylindrical shell segment 262 and end plates 264 and 266. A diaphragm 106, similar to the diaphragm 106 shown in FIGS. 10 and 11, is secured to cylindrical housing segment 262 to define separately inflatable diaphragm chambers which may be inflatable by air under pressure through access port 104 communicating with access bore 102 which feed each separate diaphragm chamber. Air under pressure is fed to each diaphragm chamber through a manifold defined by a plate 268 spaced from end plate 266 to define a plenum chamber 270 where air under pressure is distributed to each access bore 102 and access port 104 feeding each separate diaphragm chamber.

To supply air under pressure to plenum chamber 270 an air distribution housing 272 is provided. Housing 272 is rotatably supported with respect to driven shaft 250 and end plate 268 associated with the diaphragm support housing so that housing 272 may be fixed while shaft 250 and plate 268 may rotate relative thereto. Air distribution housing 272 includes an air inlet 274 to accommodate a hose (not shown) from a source of air under pressure. An air access slot 276 is provided communicating with air inlet port 274 and oriented to allow introduction of air under pressure into plenum 270 to feed each of the air access ports 104 associated with each diaphragm chamber. Suitable sealing members 278 and 280 are provided adjacent the communicating juncture between air slot 276 and plenum 270 to preclude unwanted leakage of pressurized air.

An output shaft 280 having a flanged hub 282 which may be integral with shaft 280, or firmly secured in any convenient manner, is provided with the flanged hub 282 being firmly secured to end plate 264 of the diaphragm support housing assembly 260. An exterior housing may be provided comprising a cupped segment 284 carrying a bearing 286 in which the output shaft 280 may be journaled and an end cover plate 288 within which the air distribution housing 272 may be affixed.

It is thus seen that driven shaft 250 is freely rotatable when the diaphragm chambers are in a deflated mode as the roller assemblies 130 can freely rotate within the diaphragm support housing. Upon the introduction of air under pressure, each of the diaphragm chambers inflate, impeding the free rotation of the roller members 130, in the same manner as the brake embodiment of FIGS. 10 and 11. However, since the diaphragm support housing 260 is rotatable with respect to shaft 250, rotation of shaft 250 imparts a like rotative motion to the diaphragm support housing thus driving output shaft 280. It is apparent that by controlling the amount of air under pressure fed into each diaphragm chamber, the degree of relative rotation between input shaft 250 and output shaft 280 can be precisely controlled from a first condition where shaft 250 free wheels relative to shaft 280 with no rotation imparted to shaft 280 through an infinitely variable range of relative slipping as the rollers 130 slip relative to partially inflated diaphragm chambers to a final direct coupling link when the diaphragm chambers are inflated to a full extent.

Thus, with the embodiment of the present invention as illustrated in FIG. 14, it is readily apparent that a pneumatically controlled clutch assembly is provided where the degree of slipping between the input shaft and the output shaft is controlled by precisely metering and controlling a source of air under pressure.

Figure 16:
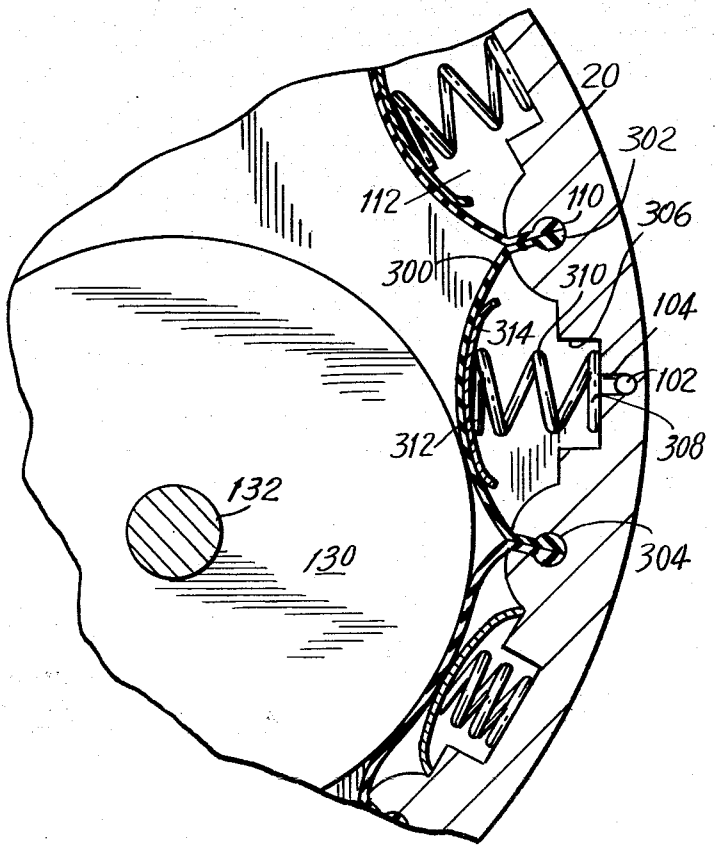
FIG. 16 is a view similar to FIG. 15 showing the embodiment of FIG. 15 in a second position of operation.
Figure 15:
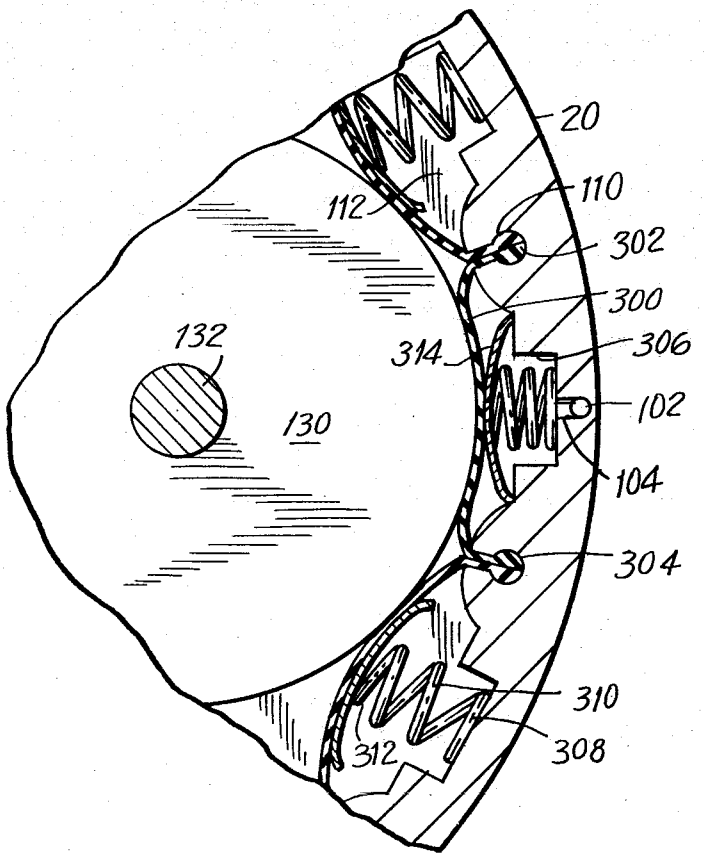
FIG. 15 is a partial sectional view of another embodiment of the present invention.

Reference is now made to FIGS. 15 and 16 which illustrate an alternate embodiment of the present invention useful with the embodiment shown in FIGS. 3–5 to increase the magnitude of air which may be pumped out of the system when the embodiment of FIGS. 3–5 is used as an air pump. In this embodiment, each diaphragm chamber is formed of a separate flexible membrane 300 having a semi-circular, in cross-section, bead at each lateral edge 302 and 304, respectively, which, along with an adjacent membrane, is secured in each keyhole slot 110 formed in housing 20.

Within each diaphragm chamber 112, housing 20 is counterbored as at 306, to form a seat for one end 308 of a compression spring member 310. The other end 312 of compression spring member 310 is provided with an arcuately shaped support plate 314 which acts against the diaphragm 300 to urge the diaphragm into an expanded radially inwardly directed mode. Thus, as the input shaft is rotated from an external power source, the roller members 130 act against the compression spring 310 to depress the diaphragm radially outwardly against housing 20 and, as the diaphragm is so deflected, pump air trapped within the diaphragm chamber out through the system. FIG. 16 illustrates the compression and expansion of the diaphragm members as roller 130 moves in a clockwise direction under the action of the rotating input shaft.

It is thus seen that the present invention provides a reversible fluid device which can act as a motor, pump or clutch and which is relatively simple to construct. The device operates efficiently to produce a uniform torque output at varying speeds of output from a source of air from a uniform pressure source.

What is claimed is:

1. A reversible fluid device comprising a housing, a plurality of circumferentially spaced separately sealed diaphragm chambers disposed within said housing, shaft means rotatably supported with respect to said housing, a hub means within said housing fixed to said shaft means, and disposed radially inwardly from said diaphragm chambers, a plurality of circumferentially spaced roller members rotatably mounted on said hub means disposed for rolling contact with said diaphragm chambers, fluid communication means operatively associated with each said diaphragm chamber and fluid distribution means to sequentially supply fluid under pressure to selected ones of said fluid communication means thereby to selectively expand selected ones of said diaphragm housings radially inwardly to bear against a contiguous roller member to impart relative rotation thereto and to said shaft means, said fluid distribution means comprising an inlet from a source of fluid under pressure in communication with fluid distribution means fixed to said shaft means whereby said fluid under pressure is selectively distributed to said fluid communication means as said shaft means rotates, said fluid distribution means further comprising a housing fixed to said shaft means including fluid passage means communicating from said inlet from a source of fluid under pressure to a plurality of circumferentially spaced fluid access ports in an end face of said housing, control means interposed between said fluid distribution means and said fluid communication means to control the flow of fluid under pressure from said fluid distribution means to said fluid communication means, and said fluid communication means further comprising a plurality of circumferentially spaced fluid access ports in a circular array disposed through an end face of said housing with each said fluid access port communicating with a radially disposed fluid access channel in said end face of said housing to each said diaphragm chamber and wherein said control means comprises a plate member having a plurality of circumferentially spaced fluid access ports therethrough in circular array arranged to be selectively registrable with said fluid access ports in said end face of said housing.

2. A reversible fluid device as defined in claim 1 wherein the number of said diaphragm chambers are twice the number of roller members plus one.

3. A reversible fluid device as defined in claim 1 wherein fluid under pressure is sequentially supplied to selected ones of said diaphragm chambers by said fluid distribution means as a pulsed input for a short duration and wherein as said roller members rotate a roller member moving into contact with a selected one of said diaphragm members which is not being supplied with a pulse of fluid under pressure returns said diaphragm chamber to its unexpanded state thereby exhausting fluid from said diaphragm chamber.

4. A reversible fluid device as defined in claim 1 wherein said control plate member is movable from a first position with its fluid access ports in register with a like number of corresponding fluid access ports in said housing end plate to an intermediate neutral position where said control plate fluid access ports are disposed between said end plate fluid access ports thereby precluding fluid flow therethrough to a third position wherein each said fluid control plate fluid access port is in register with a circumferentially adjacent end plate fluid access port from the access port in said first position.

5. A reversible fluid device as defined in claim 4 wherein said control member when in its said first position distributes fluid under pressure to selected ones of said diaphragm chambers as one of said roller members contiguous thereto is positioned just past the midpoint of said selected ones of said diaphragm chambers thereby to impart a force thereto tending to rotate said roller members in a first direction and wherein said control member when in its said third position distributes fluid under pressure to selected ones of said diaphragm chambers as one of said roller members contiguous thereto is positioned just past the midpoint of said selected ones of said diaphragm chambers thereby to impart a force thereto tending to rotate said roller members in a direction opposite to said first direction.

6. A reversible fluid device as defined in claim 1 wherein said diaphragm chambers are formed by a diaphragm member which is a flexible rubber-like material.

7. A reversible fluid device as defined in claim 6 wherein said diaphragm member is a cylindrical segment disposed within said housing and having its lateral edges secured therein, said diaphragm member being further secured within said housing at circumferentially spaced locations along its longitudinal length to define said plurality of separately sealed diaphragm chambers.

8. A reversible fluid device as defined in claim 1 wherein each said diaphragm chamber includes a piston chamber within a piston chamber disposed on said housing, said fluid communication means communicating with said piston chamber and said piston member being movable from a first outward position to a radially inward position responsive to the introduction of fluid under pressure through said fluid communication means into said piston chamber and wherein said piston member includes a bearing member at its radially inward end adapted to bear against a selected one of said roller members.

9. A reversible fluid device as defined in claim 8 including biasing means within each said piston chamber to bias said piston and bearing member radially outwardly such that in the absence of fluid under pressure in said piston chamber said piston and bearing member are urged into said first outward position.

10. An air pump device comprising a housing, a plurality of circumferentially spaced separately sealed diaphragm chambers disposed within said housing, input shaft means adapted to be driven by a power source rotatably supported with respect to said housing, hub means within said housing fixed to said input shaft means and disposed radially inwardly from said diaphragm chambers, a plurality of circumferentially spaced roller members rotatably mounted on said hub means and disposed for selected rolling contact with each said diaphragm chamber as said input shaft is rotated, each said diaphragm chamber having a diaphragm element movable from a first radially inward extended position to a second radially outward retracted position respective to contact of said diaphragm element by a selected one of said roller members as said input shaft is rotated, fluid communication means operatively associated with each said diaphragm chamber to receive air under pressure generated within each said diaphragm chamber responsive to the movement of each said diaphragm element from its said first position to its said second position, fluid distribution means comprising outlet means in fluid communication with said fluid communication means in communication with fluid distribution means fixed to said shaft means whereby said fluid under pressure is selectively accumulated from said fluid communication means as said shaft means rotates, said fluid distribution means further comprising a housing fixed to said shaft means including fluid passage means communicating from said outlet means to a plurality of circumferentially spaced fluid access ports in an end face of said housing, control means interposed between said fluid distribution means and said fluid communication means to control the flow of fluid under pressure from said fluid communication means to said fluid distribution means, and said fluid communication means further comprising a plurality of circumferentially spaced fluid access ports in a circular array disposed through an end face of said housing with each said fluid access port communicating with a radially disposed fluid access channel in said end face of said housing to each said diaphragm chamber and wherein said control means comprises a plate member having a plurality of circumferentially spaced fluid access ports therethrough in circular array arranged to be selectively registrable with said fluid access ports in said end face of said housing.

11. An air pump device as defined in claim 10 wherein each said diaphragm chamber includes biasing means therein operatively associated with each said diaphragm element to maintain said diaphragm element in its said first position whereby as each said diaphragm element is contacted by one of said roller elements said diaphragm element is moved from its said first position to its said second position against the action of said biasing means.

12. An air pump device as defined in claim 11 wherein said biasing means is a compression spring member.

13. An air pump device as defined in claim 10 wherein each said diaphragm chamber includes a piston member within a piston chamber disposed on said housing, said fluid communication means communicating with said piston chamber and a diaphragm element fixed to said piston member, said diaphragm element and piston member being movable from said first position to a said second position responsive to contact of said diaphragm element by a selected one of said roller members as said input shaft is rotated.

14. An air pump device as defined in claim 13 including biasing means associated with each said piston member to maintain said piston member and its diaphragm element in its said first position whereby as each said diaphragm element is contacted by one of said roller elements said diaphgram element and piston member is moved from its said first position to its said second position against the action of said biasing means.

15. An air pump device as defined in claim 14 wherein said biasing means is a compression spring member.

* * * * *